US011241898B2

(12) United States Patent
Lang

(10) Patent No.: US 11,241,898 B2
(45) Date of Patent: Feb. 8, 2022

(54) PRINTING SYSTEM AND METHOD FOR PROTECTING A PRINT HEAD UPON PRINTING TO A RECORDING MEDIUM

(71) Applicant: Canon Production Printing Holding B.V., Venlo (NL)

(72) Inventor: Robert Lang, Allershausen (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/985,696

(22) Filed: Aug. 5, 2020

(65) Prior Publication Data

US 2021/0039410 A1 Feb. 11, 2021

(30) Foreign Application Priority Data

Aug. 5, 2019 (DE) ..... 102019121077.1

(51) Int. Cl.
*B41J 25/308* (2006.01)

(52) U.S. Cl.
CPC ..... *B41J 25/308* (2013.01)

(58) Field of Classification Search
CPC ..... B41J 25/308; B41J 25/3084
See application file for complete search history.

(56) References Cited

U.S. PATENT DOCUMENTS

2002/0001006 A1 1/2002 Matsumoto et al.
2005/0195262 A1* 9/2005 Takeda ..... B41J 11/06 347/103

FOREIGN PATENT DOCUMENTS

DE 102013208753 B4 3/2019
JP 2015160380 A 9/2015
WO 2014156886 A1 10/2014
WO WO-2014156886 A1 * 10/2014 ..... B41J 15/04
WO 2019007980 A1 1/2019

OTHER PUBLICATIONS

Oka, MachineTranslationofWO-2014156886-A1, 2014 (Year: 2014).*
German Patent Office Search Report for German Application No. DE 10 2019 121 077.1, dated Mar. 23, 2020.

* cited by examiner

*Primary Examiner* — Scott A Richmond
(74) *Attorney, Agent, or Firm* — Schiff Hardin LLP

(57) ABSTRACT

A printing system having: a print head arranged with a predetermined nip for printing to a recording medium; a sensor positioned upstream of the print head, and configured to detect possible joints of the recording medium; a spacer arranged in a region of the print head, the spacer being configured to be displaceable to deflect the recording medium and increasing a distance between the print head and recording medium; an actuator to displace the spacer element; and a controller configured to activate the actuator to displace the spacer upon detection of a joint by the sensor.

13 Claims, 7 Drawing Sheets

Figure 1A:
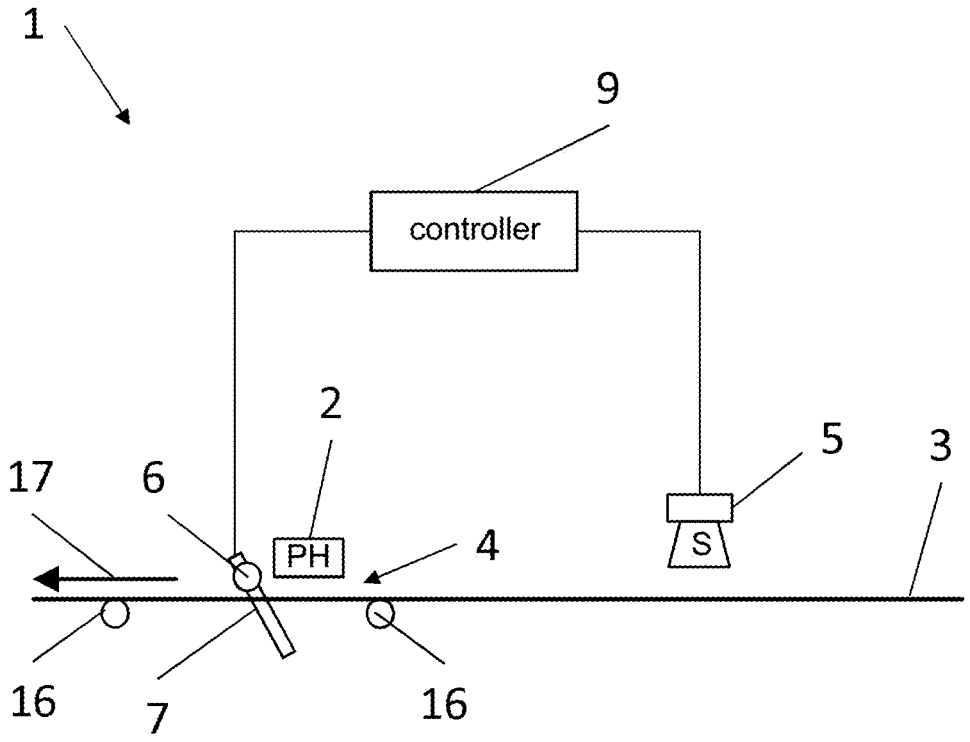

PRINTING SYSTEM AND METHOD FOR PROTECTING A PRINT HEAD UPON PRINTING TO A RECORDING MEDIUM

CROSS REFERENCE TO RELATED APPLICATIONS

This patent application claims priority to German Patent Application No. 102019121077.1, filed Aug. 5, 2019, which is incorporated herein by reference in its entirety.

BACKGROUND

Field

The disclosure relates to a printing system, in particular an inkjet printing system, and a method for protecting a print head upon printing to a recording medium, in particular with such a printing system. Although the present disclosure is explained in the following using inkjet printing systems, it is not limited to these, but rather is transferable to a multitude of printing systems, in particular systems for contactless printing.

Related Art

In an inkjet printing process, a distance of a print head from a recording medium is typically chosen to be as small as possible in order to achieve a precise positioning of the individual ink droplets on the recording medium. However, this is problematic in the instance of a joint occurring on the recording medium, for example as a result of a change of recording medium, given which often a preceding recording medium and a new recording medium are joined with one another, in particular are glued to one another. For example, for this a new web of the recording medium may be connected with an old web via an adhesive strip. Joints may also be provided in the production of a recording medium and, under the circumstances, may emerge unforeseen within a roll.

Often, an overlap of two recording medium webs is provided at such a joint. Due to a fault, such as fold, a projecting edge, an undulation as a result of the gluing, or the like, the adhesive joint may also have a markedly greater thickness than the actual recording medium. However, the joint traverses the entire printing system, including the printing station at which the print head is located. However, a print head is extremely sensitive and may be damaged by a possible contact of the recording medium. Since print heads are among the most expensive components of a printing system, upon detection of a joint the printing system is normally initially halted in order to adjust the print heads into a secure maintenance position and thus to avoid damage. A corresponding subsequent passage of the joint through the complete system, as well as a following ramp-up of the printing system, generate quite a large amount of spoilage.

DE 10 2013 208 753 B4 describes a movable inkjet nozzle bar that can be displaced between a printing position and a maintenance position relative to the recording medium. In the event of a roll change with a gluing process, the nozzle bar is therefore displaced relative to the recording medium or, respectively, to a central cylinder guiding the recording medium, in order to thus sufficiently increase the distance. The joint may then be harmlessly directed past the print heads. However, this is a comparably slow process, since the quite sensitive print heads may only be moved carefully with comparably slow accelerations.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1A a schematic depiction of a segment of a printing system according an embodiment of the present disclosure.

Figure 1B:
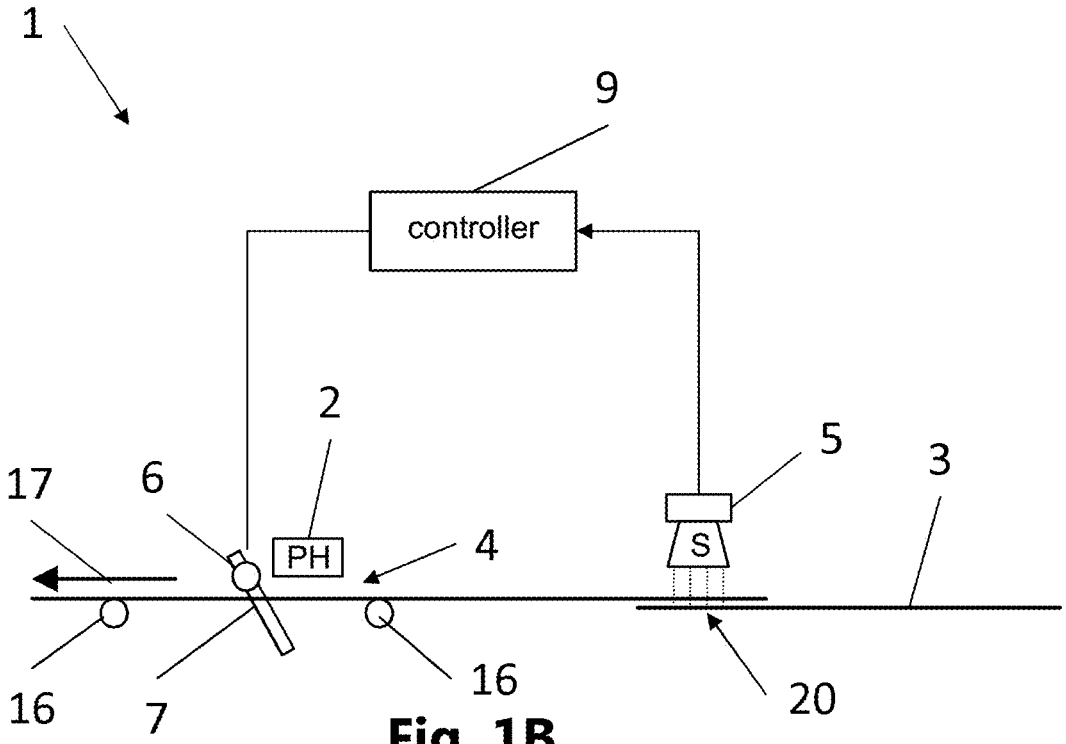

FIG. 1B the printing system according to FIG. 1A, given detection of a joint.

Figure 1C:
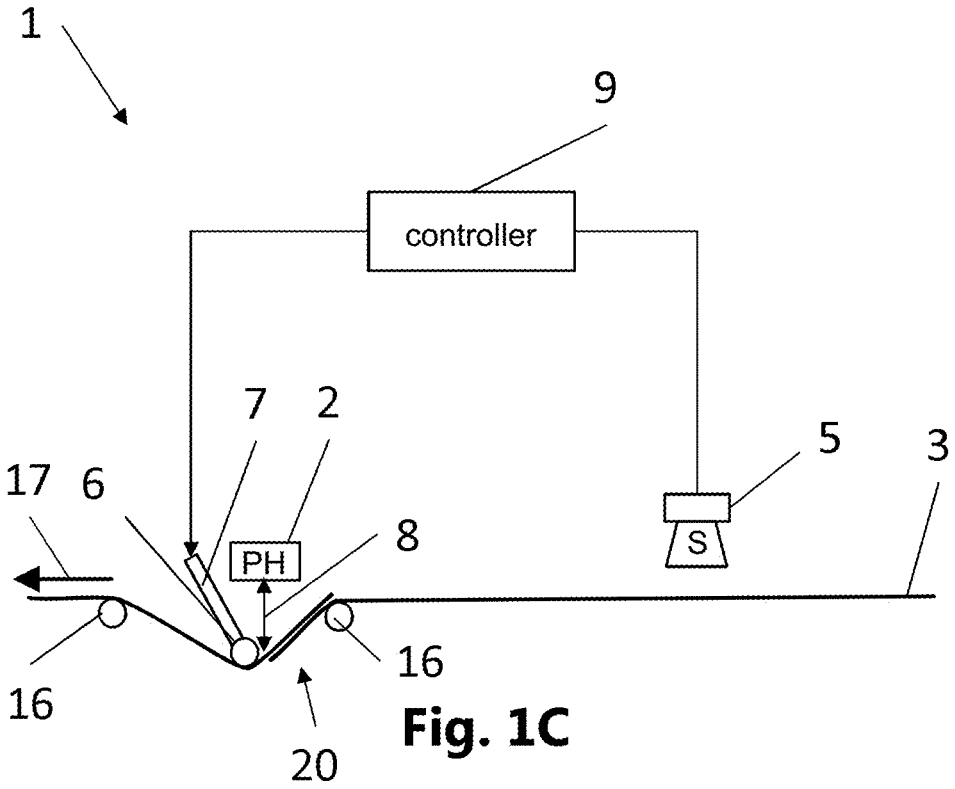

FIG. 1C the printing system according to FIG. 1B, with displaced spacer element.

Figure 2:
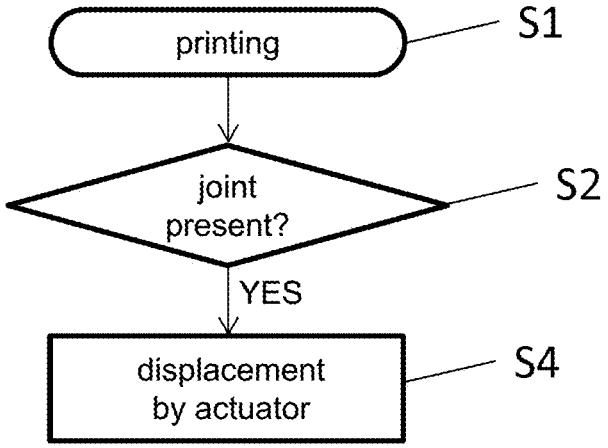

FIG. 2 a flowchart of a method for protecting a print head upon printing to a recording medium according an embodiment of the present disclosure.

Figure 3:
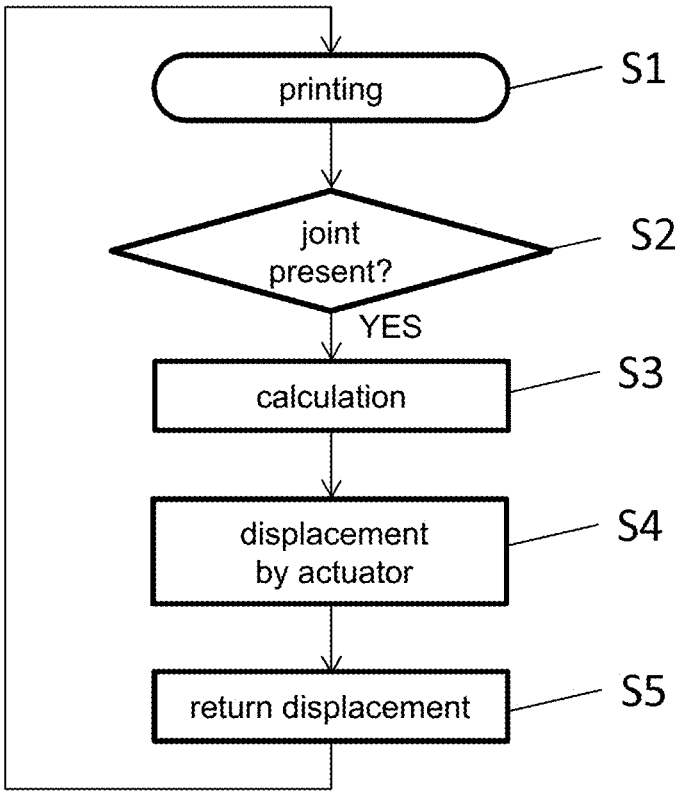

FIG. 3 a flowchart for a method for protecting a print head upon printing to a recording medium according an embodiment of the present disclosure.

Figure 4:
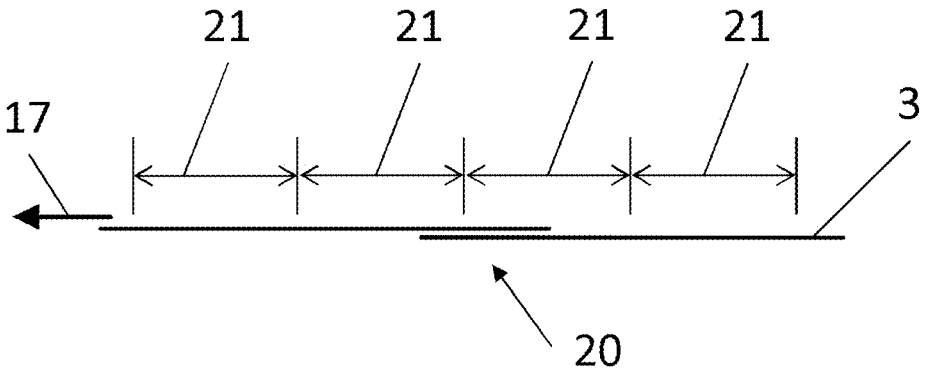

FIG. 4 a schematic depiction of the joint relative to a page format according an embodiment of the present disclosure.

Figure 5A:
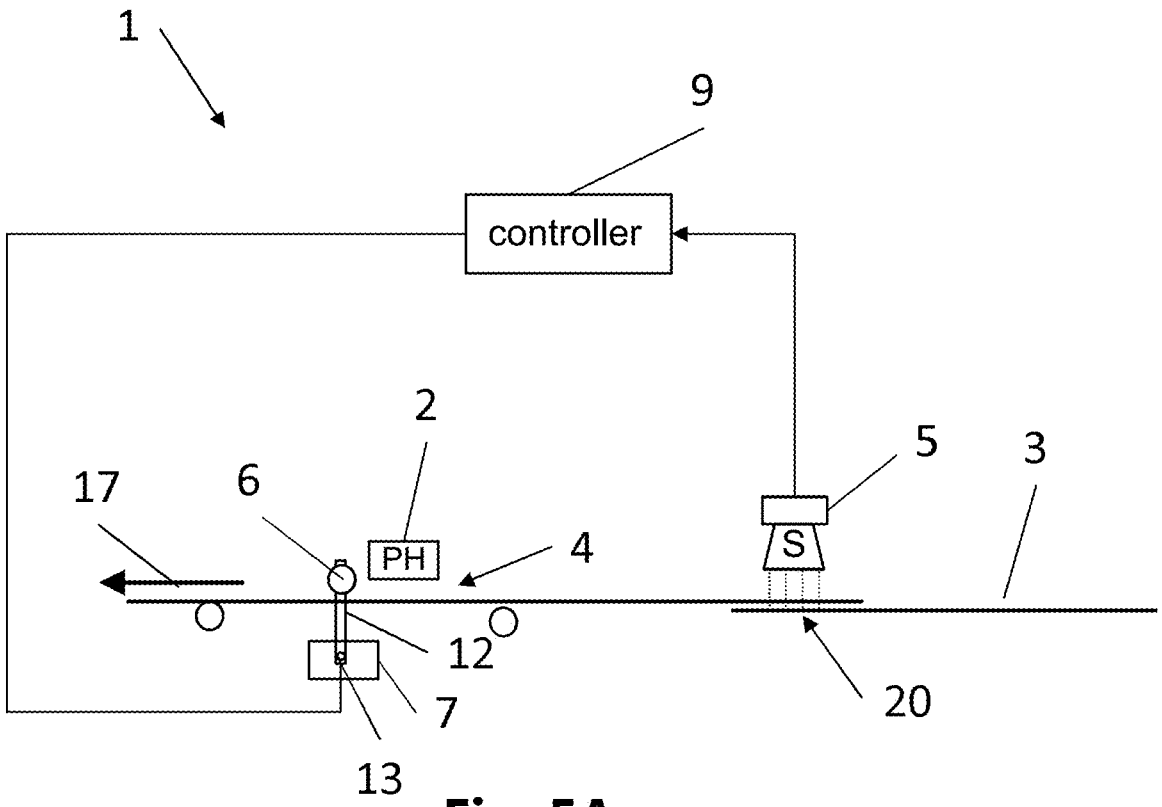

FIG. 5A a schematic depiction of a segment of a printing system according an embodiment of the present disclosure.

Figure 5B:
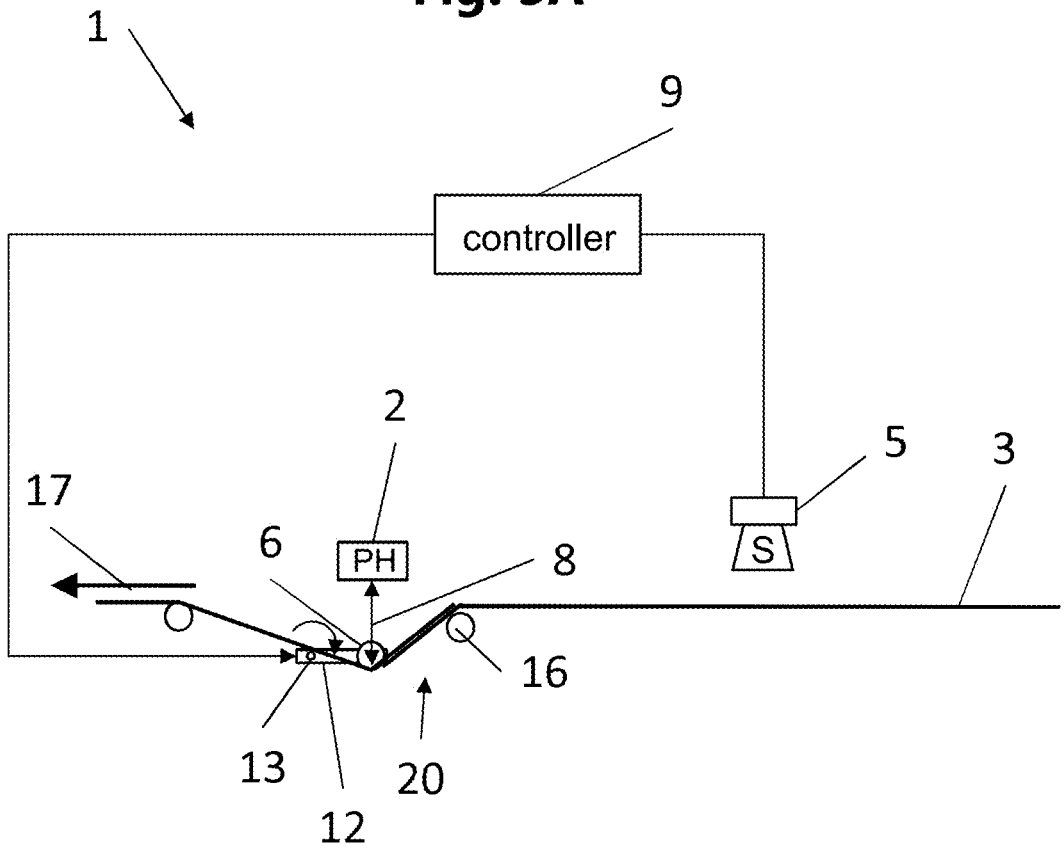

FIG. 5B the printing system according to FIG. 5A, with displaced spacer element.

Figure 6:
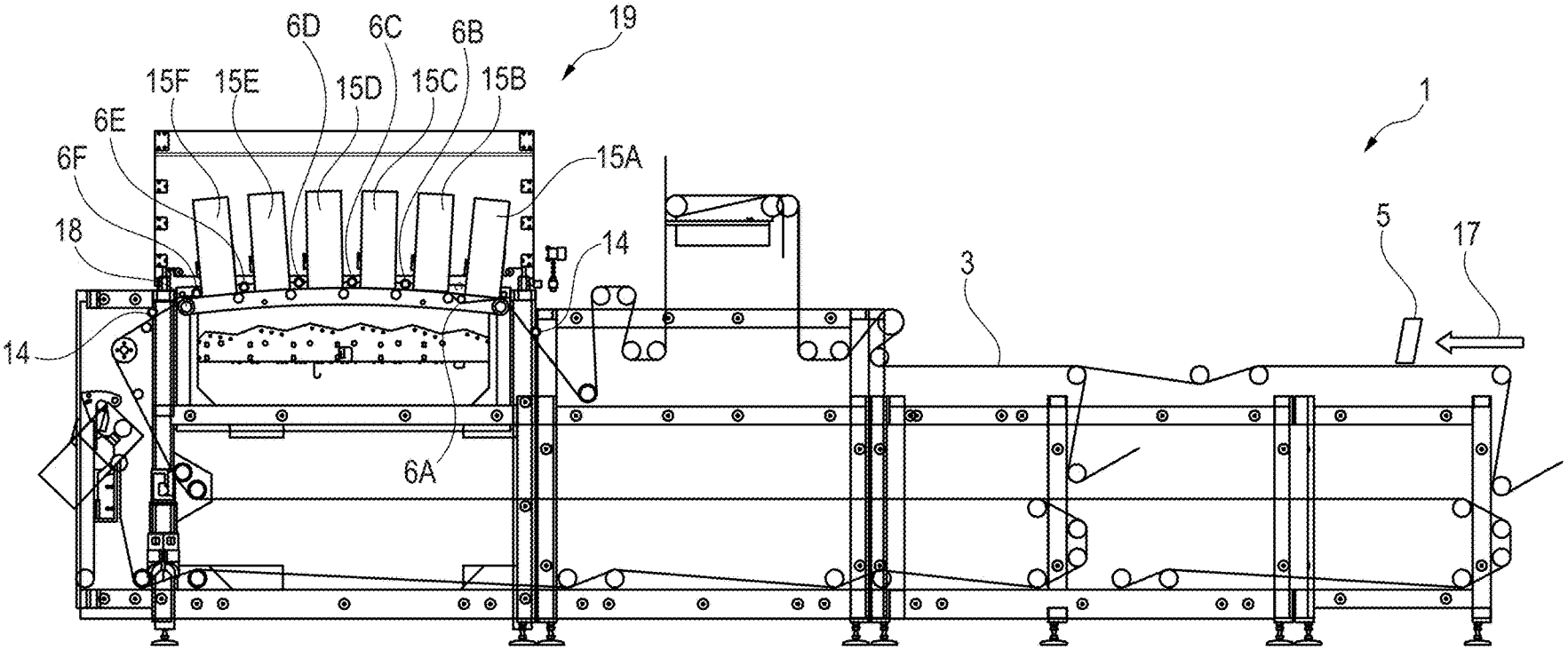

FIG. 6 a side view of a printing system according an embodiment of the present disclosure.

Figure 7:
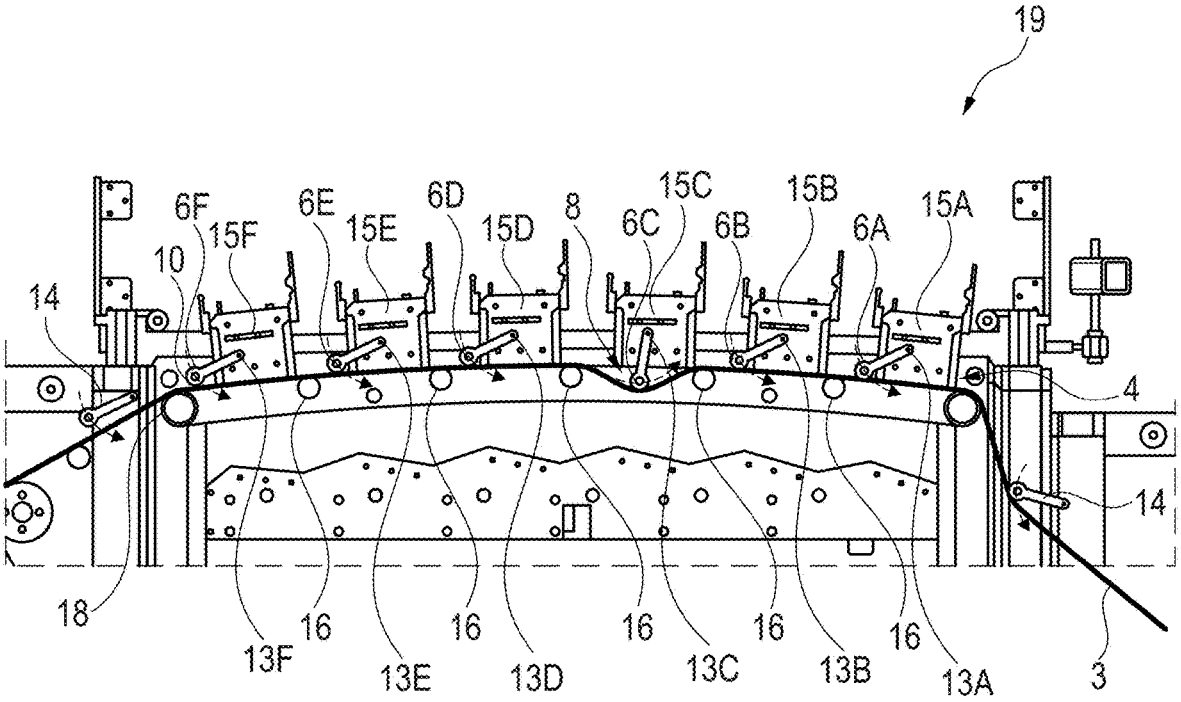

FIG. 7 a detail view of a printing station according an embodiment of the present disclosure.

Figure 8:
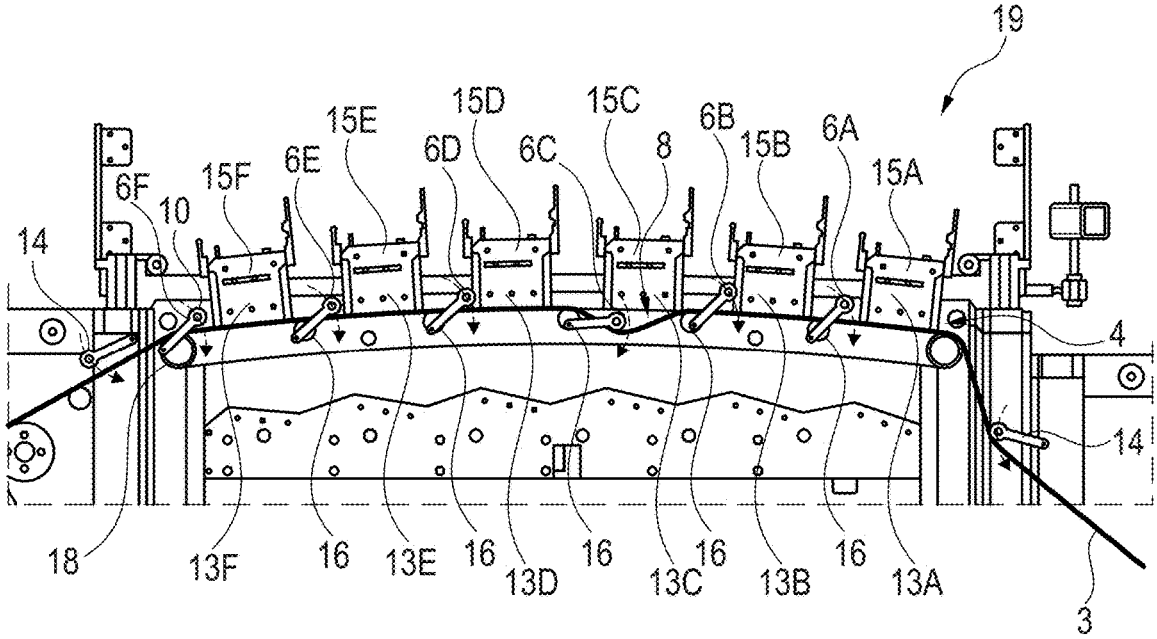

FIG. 8 a detail view of a printing station according an embodiment of the present disclosure.

Figure 9:
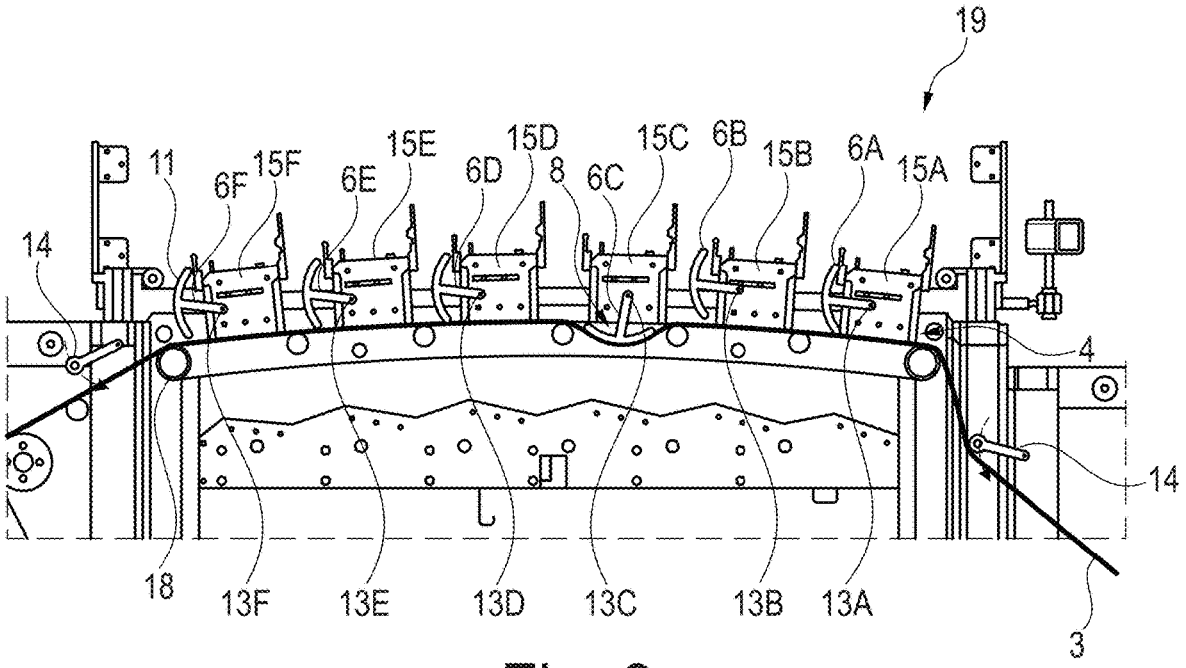

FIG. 9 a detail view of a printing station according an embodiment of the present disclosure.

Figure 10:
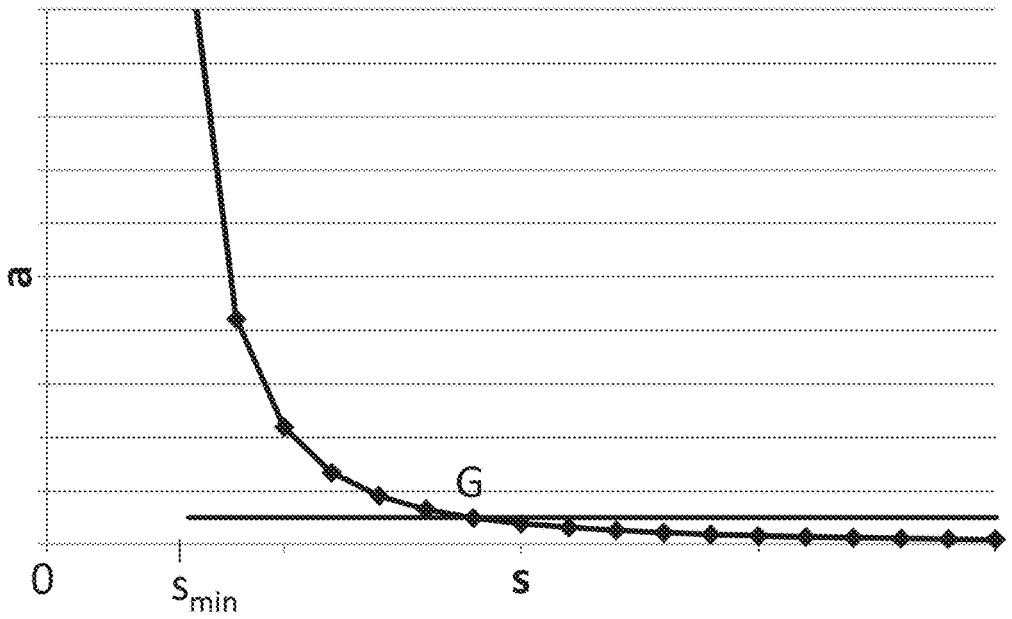

FIG. 10 a diagram of the acceleration for spacing above the spoilage length according an embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure it to provide an improved printing system and an improved method for protecting a print head upon printing to a recording medium.

The disclosure relates to a printing system, in particular an inkjet printing system, having: at least one print head that is arranged with a predetermined nip for printing to a recording medium; a sensor positioned before the print head, which sensor is configured to detect possible joints of the recording medium; a spacer element arranged in the region of the print head, which spacer element is configured so as to be displaceable for deflection of the recording medium and increasing a distance between print head and recording medium; an actuator provided to displace the spacer element; and a controller which is configured to activate the actuator to displace the spacer element upon detection of a joint by the sensor.

The disclosure also relates to a method for protecting a print head upon printing to a recording medium, in particular with a printing system according to the disclosure, having the steps: printing to a recording medium with at least one print head, wherein a predetermined nip is set; checking the recording medium with a sensor upstream of the print head, to detect possible joints of the recording medium; upon detection of a joint, displacement, by means of an actuator, of a spacer element for local deflection of the recording medium in the region of the print head, wherein a distance between print head and recording medium is increased.

An object of the disclosure is to provide a deflection of the recording medium to temporarily increase the distance in the region of the nip to protect the print head in the event of a joint of the recording medium. In this way, a protection of the print head is ensured even in the event of a thickness variation at the joint that exceeds the nip, without the printing system or the feed of the recording medium needing to be halted for this purpose. The print head also does not need to be moved for this purpose. In particular, thick folds, overlaps, or other faults of the joint may be safely kept away from the print head, which remains in the printing position as before. The distance between recording medium and print head, which distance can be produced according to the disclosure by the spacer element, is therefore greater than the nip. For example, even folds or overlaps that are multiple millimeters high are thus safely kept away from the print heads via the deflection element. Due to the additional deflection, the web must dodge in a direction counter to the print heads.

The spacer element may additionally be configured as a protective element and be displaced into an intervening space between print head and recording medium, such that it, in addition to the spacing, keeps possibly protruding folds or the like away from the print head.

Upon detection or recognition of a joint, the spacer element according to the disclosure may be displaced a great deal faster than the sensitive print head, and in particular without consideration of the ink hydraulic system. No stopping of the printing system is thus necessary. The distancing and, if applicable, protective function may therefore be realized with a great deal less spoilage. For example, given a conventional inkjet printing system the spoilage for a system ramp-up after a system stop, which is typically executed upon detection of a joint, is up to 60 m of recording medium web. This corresponds, for example, to a weight of approximately 7.5 kg given a high-grade paper of 250 g/m$^2$ web weight and 0.5 m web width. This high spoilage consumption is predominantly avoided according to the disclosure and is reduced to a minimum in the range of individual pages. In particular, according to the disclosure it is avoided that a printing process must be halted upon detection of a joint in order to displace the print heads into a maintenance position, and may only be restarted again if the joint has been conveyed through the entire printing line. Rather, to protect the print head according to the disclosure the recording medium may merely be deflected temporarily, in particular for a predetermined time and accordingly for a feed path predetermined as accruing a comparably small spoilage. The printing system, in particular the feed of the recording medium, thus continues to run without interruption. The printing process itself does not necessarily need to be halted for this; rather, an additional spoilage identifier may be printed during the time of the deflection. Even if the printing process is halted, this is only necessary for a very short duration, for example of a few seconds, until the spacer element is displaced back again and the recording medium is in the printing position again. No press proof whatsoever is thus necessary after the passage of the joint; rather, the regular printing may be directly continued directly after passage of the joint. According to the disclosure, a large quantity of spoilage is thus saved, and the cost for what is known as the reprint—meaning the retroactive ensuring that missing documents or duplicates are prevented—is reduced.

With this as background, according to the disclosure roll changes are possible in a manner that saves a great deal of time and expense. In particular, in this way a roll change may also be performed as needed or "on demand" in a simple and economic manner, depending on the job position. Alternative or additional automated roll changes are also not problematic. In particular, a printing system according to the disclosure may have an automatic roll changer to exchange various recording medium types, for example having various thicknesses, as needed. In the event of an automatic roll change, printing may be directly continued, without interruption, with low spoilage. According to the disclosure, on the one hand the productivity and on the other hand the flexibility of a printing system are thus increased, in particular even in the event of an inkjet printing system having sensitive inkjet print heads. In principle, the automatic handling of joints or adhesive joints given optimally low spoilage is gaining importance for inkjet printing systems, in particular in the graphics market. High production speeds in connection with ever higher grade, heavier papers lead to comparably short roll change intervals of approximately 60 min and less, for example. Automatic roll changers that may exchange a recording medium in running printing operation without stopping therefore increase the productivity. For example, if approximately 10 minutes of time consumed for a manual roll change and approximately 60 minutes of roll runtime are assumed, the possible increase in the productivity is approximately 17%, for example. Given a possible "on demand" activation for switching to a second recording medium type, the automatic adhesive joint handling becomes even more important. A further fundamental advantage is therefore the gain in flexibility when switching back and forth between different paper types may be performed depending on the product, without incurring large quantities of spoilage.

A print head may in particular be incorporated into what is known as a print bar, which contains a plurality of print heads to cover the entire web width of a recording medium. A plurality of print bars is preferably provided to represent a color system for example a CMYK (cyan, magenta, yellow, and black or, respectively, key) system. In particular, a print bar, and accordingly a print head contained therein, may be provided for printing a defined color of the color system. Moreover, a print bar with a print head contained therein may also be provided to apply a coating substance or primer, in particular an adhesion promoter and/or a coagulation substance to improve the print quality. Moreover, additional print bars are possible for printing with a special ink, security ink, or the like.

The sensor for detecting possible joints of the recording medium is arranged at a predetermined position, and in particular is configured to detect possible joints or possibly other faults of the recording medium across the entire width of the recording medium. In particular, it may also be a series of a plurality of sensors arranged in parallel to cover the entire web width. For example, the sensor may be fashioned as an ultrasound sensor and be configured to detect a local increase of the thickness of the recording medium. The spatial arrangement of the sensor is in particular spaced apart from the print bar in order to ensure a sufficient reaction time for the displacement of the spacer element upon detection of a joint.

The joints that can be detected by means of the sensor may in particular be adhesive joints, which are typically provided given a roll change. It may thereby be a joint between two similar recording media, or between two different recording media, for example having a different thickness.

In particular, the recording medium may be a paper web, wherein different paper types, thicknesses, and/or qualities can be printed to with the printing system. Joints may, for example, be provided in the event of a recording medium change to modify the paper thicknesses that are to be printed to. However, joints may also self-evidently be provided for simple roll changes in the event of a consumed roll. In addition to paper, the most varied other printable recording media are also considered in addition to paper, preferably recording media in the form of a web, for example plastic films and/or metal films, textiles, multilayer composites or the like.

The actuator provided for displacement of the spacer element may have the most varied embodiments. For example, it may be a rotation drive, in particular with a rotation motor, preferably a servomotor or stepper motor, or a linear drive, for example with a belt, chain, or spindle drive or with a linear motor, which actuates a predetermined movement of the spacer element. It may thereby be a translational displacement, a rotation, or a combination thereof. In particular, the actuator is an electrical actuator, wherein other types of actuators would also be conceivable, for example pneumatic actuators.

The controller may be a separately provided controller or a controller integrated as a software module into the machine controller of a printing system. An external controller would also be conceivable. In an exemplary embodiment, the controller includes processor circuitry that is configured to perform one or more functions/operations of the controller.

According to one embodiment, the spacer element is configured as a deflection roller. In this way the recording medium is advantageously deflected with low friction. In a further embodiment, the spacer element is configured as a deflection slide plate. Such a spacer element advantageously provides the deflection of the recording medium in a freely fashionable three-dimensional shape so that the recording medium may be directed three-dimensionally, for example around a continuously curved slide plate shape. Due to the freer shaping capability, such a slide plate may also advantageously be realized with smaller installation space than a deflection roller. Moreover, different curvatures are possible over the course of the slide plate, such that, for example, an introduction of the deflection slide plate may be realized via a starker curvature at the edge and a slide face via a lesser curvature in the middle. Furthermore, combinations of a deflection slide plate and a deflection roller are conceivable, or if applicable of a plurality of deflection slide plates or a plurality of deflection rollers, or both. The plurality of deflection slide plates and/or deflection rollers may jointly form a spacer element. However, it would also be conceivable to associate a plurality of spacer elements with a print head, which spacer elements may respectively have a singular deflection slide plate and/or deflection roller or a plurality of deflection slide plates and/or deflection rollers.

According to one embodiment, the spacer element is arranged on the same side of the recording medium as the print head. For spacing, the spacer element therefore enters between the recording medium and the print head. In particular, it enters into an intervening space between the recording medium and the print head. In this way, the spacer element may simultaneously serve as a protective element and prevent the possibility of the joint of the recording medium smacking the print head, in particular by larger faults that are provided in the region of the joint, such as folds, dog-ears, undulations, or the like.

According to one embodiment, the spacer element has a pivot lever that is configured so that it can be pivoted by an actuator around a rotation point to increase the distance. In this instance, the actuator may be configured as a rotation motor. It is preferably a servomotor or stepper motor. It may particularly preferably be a position-monitored precision servo drive. A realization of the actuator without a translatory actuator, for instance a more expensive linear motor or a more complicated and larger spindle drive, is thus advantageously enabled. In this way, a pivoting by a comparably small angular segment, for example <90°, in particular <60°, may already suffice for a sufficient displacement of the spacer element. Very fast reaction times are thus enabled for the displacement of the spacer element.

According to one development, the rotation point is arranged on the same side of the recording medium as the print head. In particular, the rotation point may also be provided at the level of the print head, in particular in or on the housing of a print bar. Alternatively, a mounting on a frame of the printing station that is extended up to the level of the print bar would also be conceivable. In this way, in the displaced state the pivot level may advantageously be aligned nearly orthogonal to the feed direction of the recording medium, so that the moments that the actuator must stop are less strong. In this way, the actuator may advantageously have smaller dimensions.

According to a further embodiment, the rotation point is arranged on the opposite side of the recording medium from the print head. In this way, a deflection may advantageously be realized without additional installation space being required for this in the region of the print bar. In this way, the printing station may be kept compact, and in particular its measurements do not increase in size in comparison to a conventional printing station. In particular, no consideration whatsoever also thereby needs to be made for the supply lines provided in the region of the print heads.

A print head is preferably arranged in a region between two deflection rollers that guide the recording medium and are provided to maintain the nip. Independently of how the spacer element is mounted, it can advantageously be introduced between the two deflection rollers for additional deflection of the recording medium to produce the increased distance.

According to one embodiment, a compensation element that can be actuated by means of an actuator is provided upstream of the spacer element, which compensation element is configured for position compensation of the recording medium via a counter-movement upon displacement of the deflection element. Alternatively or additionally, a compensation element that can be actuated by means of an actuator, said compensation element being for corresponding position compensation of the recording medium, may also be provided downstream of the spacer element. In this way, it is avoided that the recording medium is retracted from an uncontrolled direction, or is released without control upon return displacement, due to the displacement of the spacer element. For this, the upstream compensation element may be introduced into the web of the recording medium at an initial location and deflect said web locally in order to release the web for position compensation upon displacement of the spacer element. In an initial location, the downstream compensation element may be arranged next to the web of the recording medium and locally deflect this for position compensation upon return displacement of the spacer element. In this instance, the controller is configured to control the compensation element or the compensation elements for position compensation upon displacement of the spacer element. For example, a displacement of the spacer element may be performed synchronously with the displacement of the upstream compensation element and with an identical deflection, such that an in-register printing is enabled at currently unaffected print heads, in particular at the adjacent print bars of the printing station, in spite of the spacing. In the event of a double-sided print job, the downstream compensation element also enables the further in-register printing of the second side or back side at a downstream second printing station or a downstream second printing system.

According to one embodiment, the printing system has a plurality of print bars spaced apart from one another in the feed direction, respectively having at least one print head, preferably a plurality of print heads. A spacer element is thereby associated with each print bar, which spacer element is configured and arranged to space the recording medium from the respective print bar. For example, next to each print head the spacer element may provide a rotation point for a pivot lever. The displacement of the recording medium is performed at the individual print heads in a manner so as to match one another. For this, the controller is configured to displace and return the spacer elements so as to match one another, so that a respective return displacement can be executed as a counter-movement to a displacement of the following spacer element for position compensation of the recording medium. Accordingly, a displacement of a first spacer element by the compensation element is compensated, and subsequent displacements are compensated via the return displacement of the respective present spacer elements, in particular in the manner of a cascade. In this way, a further in-register printing is advantageously enabled without registration errors at the respective print bars that are currently not affected by the spacing. A spoilage region may thus particularly advantageously be provided that is shorter than the length of a printing station or the distance from a first print bar to a last print bar.

According to one embodiment, given displacement of the spacer element, a distance that is comparatively a multiple of the nip may be established. In particular, the distance is at least ten times more. The distance may preferably be at least twenty times more. In this way, even larger faults in the region of the joint may not damage the print head. In particular, in this way it is ensured that, in addition to the doubled thickness of a joint, even possible projecting folds or overlaps may not reach the print heads. Moreover, in this way the spacer element in a displaced state may be arranged in an intervening space between print head and recording medium so that it acts as a protective element. A nip is typically chosen to be as small as possible in order to achieve a precise positioning of the ink droplets on the recording medium. A nip is typically in a range of one millimeter, whereas the distance between print head and recording medium that is enlarged with the spacer element via deflection of the recording medium is markedly greater, for example may be in the centimeter range.

In an embodiment of a method according to the disclosure, given displacement of the spacer element, a counter-movement with a compensation element upstream of the spacer element may be performed for position compensation of the recording medium. Alternatively or additionally, given displacement of the spacer element, a counter-movement with a compensation element downstream of the spacer element may be performed for position compensation. In this way, the additional web length of the recording medium that is required for displacement is not drawn in an uncontrolled manner—for example retracted from the subsequent print heads or print bars—but rather is taken from a predetermined web region before or after a printing station. For this, the upstream compensation element may be introduced in an initial position into the web of the recording medium and deflect this locally in order to release the web upon displacement of the spacer element for position compensation. In this way, given a return displacement of the spacer element, a web length thereby released is also compensated and advantageously does not influence the downstream web velocity. In an initial position, the downstream compensation element may be arranged next to the web of the recording medium in order to locally deflect this for position compensation upon return displacement of the spacer element.

According to one embodiment, after passage of the joint the compensation element is returned to an initial position multiple times slower than in the counter-movement, and a feed velocity of the recording medium that was thereby temporarily modified is detected by an encoder arranged downstream of the print head, and the printing process is adapted thereto. The registration accuracy is therefore advantageously retained upon returning the compensation element. For corresponding control, a velocity control system and its encoder that are normally present anyway in a printing system to ensure register accuracy may be used. Advantageously, no additional hardware is thus necessary. A high-resolution encoder is preferably involved in the form of a rotary encoder provided at a deflection roller, so that the printing process may be adapted with high precision to the feed velocity modified upon the return.

According to one embodiment, a plurality of print bars that are spaced apart from one another in the feed direction are respectively provided with at least one print head for printing, wherein a spacer element is associated with each print bar, and the spacer elements are successively displaced, matched to one another, for passage of the joint, wherein a return displacement of a respective spacer element after passage of the joint is respectively performed as a compensation movement for the displacement of the downstream spacer element. The spacer element of a respective upstream print head is used in this way for web length compensation. A cascade-like running position compensation is thus enabled. An influencing of print bars that are currently not affected by a displacement is advantageously avoided in this way, so that a regular, in-register continued printing is enabled there. A compensation element upstream of the first bar may accordingly remain pivoted away, and is only slowly returned after return displacement of a last spacer element which is associated with the last print bar. A slight change of the web velocity that thereby results may be detected with high resolution by an encoder downstream of the printing station, and the printing process may be correspondingly adapted.

According to one embodiment, upon detection of a joint by the sensor, the print speed and/or the feed velocity of the recording medium are reduced. In this way, as needed tolerance lengths may be reduced and/or a position precision of unprinted regions and/or spoilage pages may be increased. In particular, according to the disclosure a much more precise timing of the displacement is therefore enabled so that a spoilage page or a plurality of spoilage pages, or a print interruption, which omits the joint of the recording medium may be inserted exactly. The possibility of designing the spoilage or the print interruption to be precisely one page length, or as a defined multiple thereof, facilitates the handling or automatic discharging of the spoilage in the further processing.

According to a further embodiment of the method, upon displacement of the spacer element a predetermined feed velocity of the recording medium remains set. After a hold duration predetermined under consideration of the feed velocity, a return displacement of the spacer element is performed so that the predetermined nip is set again and the regular printing process is continued as soon as the joint has passed the print head. In this way, a spoilage region or a spoilage length of the recording medium is advantageously reduced to a minimum, since the spacing is maintained only for the duration necessary for the passage of the joint, and is subsequently directly restored.

According to one embodiment, a print job for printing to the recording medium provides a predetermined page format, and before the displacement by means of an actuator a calculation step is performed to determine a point in time of the displacement and the hold duration using the feed velocity, the page format, and a position of the joint relative to one or more pages, so that the nip is reset after a feed distance of precisely one page or a whole-number multiple of one page. In particular, in this way individual pages may simply be discharged as spoilage in a post-processing, without particular additional measures being necessary for this. In particular, in this way an automatic discharging of the spoilage in the further processing is enabled.

According to one embodiment, the printing process continues to run during the spacing, and a spoilage identifier is added to the print image during the spacing. This may in particular be provided when a print job with recurring page image and/or only a local joint that is smaller than one page or a few pages are/is involved. Due to the spoilage identifier, the spoilage is easily detected in the further processing, and in particular can be automatically discharged.

According to a further embodiment, the printing process is interrupted during the spacing and is continued again after the feed distance of precisely one page or a whole-number multiple of one page. In this way, a print head interrupts the printing process shortly before the joint arrives at the print head and the spacer element is displaced between the print head and the unprinted recording medium for deflection. Since, according to the disclosure, this requires only a very short reaction time with the spacer element, an unprinted region may advantageously be matched exactly to the page dimension, such that a simplified and in particular automated discharge is subsequently enabled.

The above embodiments and developments can be arbitrarily combined with one another, insofar as is reasonable. In particular, all features of the printing system are transferable to the method for protecting a print head upon printing to a recording medium, and vice versa.

Further possible embodiments, developments, and implementations of the disclosure encompass combinations of features of the disclosure that are described in the preceding or in the following with respect to the exemplary embodiments, even if said combinations are not explicitly cited. The person skilled in the art will thereby in particular also add individual aspects as improvements or supplementations to the respective basic form of the present disclosure.

FIG. 1A shows a schematic depiction of a segment of a printing system 1 according to an embodiment.

The printing system 1 has a print head 2 that is arranged with a predetermined nip 4 for printing to a recording medium 3.

In the depicted embodiment, as an example two deflection rollers 16 that laterally flank the print head 2 are provided to define or maintain the predetermined nip 4, which deflection rollers 16 position the recording medium 3 in a predetermined manner to maintain the nip 4 in the region of the print head 2. In particular, the deflection rollers 16 are arranged such that the recording medium is spaced uniformly with the predetermined nip 4 over the entire length of the print head. In the merely schematic depiction, for better clarity wrap angles that are provided for defined positioning for each deflection roller are not shown.

Arranged upstream of the print head 2 is a sensor 5 that is configured to detect possible joints 20 of the recording medium. In the region of such joints 20, a recording medium 3 may have overlaps, folds, or other types of faults that may be capable of damaging a sensitive print head 2, for example an inkjet print head, in the event of contact. The detection of such joints 20 thus serves to protect the print head 2 in order to take a suitable protective measure in the event of a joint.

According to the disclosure, a spacer element 6 is arranged in the region of the print head 2 in order to prevent damage to said print head 2, which spacer element 6 is configured so that it can be displaced into the region of the nip 4 as a protective measure to deflect the recording medium 3 and to temporarily increase a distance between print head 2 and recording medium 3. For this, for example, the spacer element 6 is arranged on the same side of the recording medium 3 as the print head 2. For example, upon displacement it engages in the recording medium 3 between two deflection rollers 16 flanking the print head 2, and thus deflects said recording medium 3 between the deflection rollers 16 to increase the distance between recording medium 3 and print head 2. In this way, a protection of the print head 2 is ensured even in the event of a thickness variation at the joint 20 that exceeds the nip 4, without the printing system or the feed of the recording medium needing to be halted for this.

In the event of an inkjet print head, the spacer element 6 according to the disclosure may be displaced without consideration of the ink hydraulic system of the print head 2. In this way, very high manipulating speeds and most of all accelerations may be provided without this being critical to the functionality of the print head 2.

The distance 8 between recording medium 3 and print head 2 that can be established by the spacer element 6 is markedly greater, in particular multiple times greater, than the nip 4 in a normal printing position. For example, a nip 4 may be approximately in the range of one millimeter, whereas the distance 8 between print head 2 and recording medium 3 that is increased with the spacer element 6 via deflection of the recording medium 3 is preferably markedly larger, for example is at least multiple millimeters, preferably is in the centimeter range.

An actuator 7 is provided to displace the spacer element 6. The printing system 1 also has a controller 9 coupled to the sensor 5 and the actuator 7, which controller 9 is configured to control the actuator 7 to displace the spacer element 6 upon detection of a joint 20 by the sensor 5. In this way, a very fast protective measure is enabled upon detection of a joint without needing to halt the complete printing system 1 for this purpose. In an exemplary embodiment, the controller 9 includes processor circuitry that is configured to perform one or more functions and/or operations of the controller 9, including, for example, controlling the actuator 7 to displace the spacer element 6 based on a sensor signal from the sensor 5, controlling one or more printing operations of the printing system 1, controlling operation of one or more components of the printing system 1, and/or controlling the overall operation of the printing system 1.

Here the actuator 7 provided to displace the spacer element 6 is only schematically depicted, and may have the most varied embodiments. For example, it may be a rotation drive or a linear drive that actuates a predetermined movement of the spacer element 6. The displacement of the spacer element 6 may be a translatory displacement, a rotation, or a combination of these. In particular, the actuator 7 is an electrical actuator, wherein other drive types would also be conceivable, however.

The sensor 5 is arranged at a predetermined position, where the recording medium 3 is directed with a predetermined feed velocity 17. The reaction time for a detection of possible joints 20 or other possible faults in the recording medium, which reaction time is dependent on the feed velocity 17, is sufficient for the displacement of the spacer element 6 to deflect the recording medium. For example, the sensor 5 may be fashioned as an ultrasound sensor and be configured to detect a local increase in the thickness of the recording medium 3 and relay this to the controller. As soon as the sensed thickness exceeds a predetermined value, the controller 9 may interpret this as a detection of a joint 20 and control the actuator 7 to displace the spacer element 6. In a further embodiment, the sensor 5 may also be configured to merely emit an output signal to the controller 9 upon a nominal value being exceeded, so that said controller 9 may thereupon activate the actuator 7.

The joints 20 that can be detected by means of the sensor 5 may be adhesive joints, in particular in the event of a recording medium made of paper, which adhesive joints are typically provided upon a roll change of recording medium rolls. It may thereby be a joint between 2 similar recording media or between 2 different recording media, for example with different thicknesses.

FIG. 1B shows the printing system according to FIG. 1A upon detection of a joint 20.

The joint 20 here is designed, by way of example, as an overlap bond of two recording medium webs. The locally increased thickness is detected by the sensor 5, and the correspondingly modified sensor signal is relayed to the controller 9. The controller 9 processes the sensor signal in such a manner that it controls the actuator 7 to displace the spacer element 6 if a predetermined threshold is exceeded, for example 1.5 times the nominal recording medium thickness.

FIG. 1C shows the printing system 1 according to FIG. 1B with a displaced spacer element 6.

The controller 9 gives the corresponding signal to the actuator 7 for displacement of the spacer element 6 so that said spacer element 6 establishes, with a comparably very strong acceleration, an increased distance 8 between recording medium 3 and print head 2, in that it engages in the recording medium 3 between the two deflection rollers 16 and deflects said recording medium 3 downward in the region of the print head 2. Upon displacement of the spacer element 5, a distance 8 that is multiple times, for example twenty times, greater in comparison to the nip 4 can thus be established in the running operation of the printing system 1, without halting said printing system 1. Due to the previously known feed velocity 17, the spacer element 6 may subsequently be promptly displaced back after passage of the joint 20, and the nip 4 may thus be automatically reset so that the regular printing process may be continued. The protective function may thus be realized with very little spoilage.

In particular, a precise timing of the displacement and return displacement of the spacer element 6 for the passage of the joint 20 is enabled so that exactly one spoilage page, or a predetermined number of multiple spoilage pages, or exactly one print interruption may be inserted which omits the joint 20 of the recording medium 3.

FIG. 2 shows a workflow diagram of a method for protecting a print head 2 upon printing to a recording medium 3.

In particular, such a method for protecting a print head 2 upon printing to a recording medium 3 can be implemented with a printing system according to FIG. 1A through 1C. The method includes a first step of printing S1 to a recording medium 3 with at least one print head 2, wherein a predetermined nip 4 is set. A second step contains the checking S2 of the recording medium 3 with a sensor 5, upstream of the print head 2, to detect possible joints 20 of the recording medium 3. In a next step, upon detection of a joint 20 a displacement S4 of the spacer element 6 by means of an actuator is performed for local deflection of the recording medium 3 in the region of the print head 2, wherein a distance between print head 2 and recording medium 3 is increased.

FIG. 3 shows a workflow diagram of a method for protecting a print head upon printing to a recording medium, according to a further embodiment.

In the initial state, which represents a regular printing operation, here a first step of the printing S1 to a recording medium 3 is performed with at least one print head 2, wherein a predetermined nip 4 is set. In a second step, a checking S2 of the recording medium 3 is also implemented with a sensor 5, upstream of the print head 2, to detect possible joints 20 of the recording medium 3. Upon detecting a joint, in a third step the calculation S3 is performed to determine a point in time of the displacement and the hold duration using the feed velocity 17, the page format 21, and a position of the joint 20 relative to one or more pages, so that the nip 4 is reset after a feed length of precisely one page or a whole-number multiple of one page.

In a fourth step, after the calculation of the point in time, a displacement S4 of a spacer element 6 by means of an actuator is performed for local deflection of the recording medium 3 in the region of the print head 2 wherein a distance between print head 2 and recording medium 3 is increased. In this embodiment, a print job for printing to the recording medium 3 provides a predetermined page format 21. Upon displacement S4 of the spacer element 6, a predetermined feed velocity of the recording medium 3 then remains set, and a return displacement S5 of the spacer element 6 is performed according to the hold duration predetermined under consideration of the feed velocity, so that the predetermined nip 4 is reset and the regular printing process is continued as soon as the joint 20 has passed the print head 2. The printing system may thus revert to the initial state, and the method may begin from the start.

FIG. 4 shows a schematic depiction of the joint 20 in relation to a predetermined page format 21.

The positions of the individual pages on the recording medium are also provided by the predetermined page format 21. Upon detection of the joint 20, a timing of the displacement of the spacer element 6 is matched to the positions of the pages and the page length or page format 21, depending on the feed velocity 17, such that, depending on the length of the joint 20, exactly the number of pages that is necessary for distanced passage of the print head 2 are preferably provided as spoilage pages and are subsequently discharged, so that a length of the recording medium that corresponds to this number of pages is provide as spoilage at the corresponding position. Depending on the concrete technical embodiment of the spacer element 6 and/or actuator 7, as well as the concrete design of the printing system 1 and print head 2, kinematic and/or geometric influencing variables may also additionally enter into the calculation, in particular the width of the print head 2, the length of the joint 10, the time required for the displacement itself, possible safeties or tolerances, and the like.

Further possible embodiments of the printing system and of the method for protecting a print head 2 in printing to a recording medium 3 with a printing system 1 are explained in relation to subsequent FIGS. 5A through 9.

FIG. 5A shows a schematic depiction of a segment of a printing system 1 according to a further embodiment.

According to this embodiment, the spacer element 6 has a pivot lever 12 that is configured so as to be pivotable about a rotation point 13 by means of an actuator to increase the distance 8. In this way, the spacer element 6 can be pivoted into the running recording medium 3 upon detection of a joint 20.

As an example, here the rotation point 13 is arranged on the opposite side of the recording medium 3 from the print head 2. In further embodiments, however, the rotation point 13 may also be arranged on the same side of the recording medium 3 as the print head 2.

In the initial position according to FIG. 5A, in which the spacer element 6 is positioned just above the recording medium 3, the pivot lever 12 here is, by way of example, arranged essentially orthogonal to the recording medium 3. In further embodiments, however, slanted initial positions would also be possible, of course.

Upon detection of a joint 20 by the sensor 5, the spacer element is pivoted around the rotation point 13 with the pivot lever 12. Via the pivoting, which contains a normal movement component that initially increases slowly, according to a cosine function, relative to the feed direction 17, initially a gentle injection of the spacer element 6 into the recording medium 3 and a subsequent rapid displacement are achieved.

FIG. 5B shows the printing system according to FIG. 5A with a displaced spacer element 6.

Here the pivot lever 12 is pivoted to the side according to the drawn tilt arrow, so that the spacer element 6 deflects the recording medium 3 in the region of the print head 2 and establishes an increased distance 8 in-between. In this way, the joint 20 is safely directed past the print head 2 at a distance and may pass this harmlessly in the running operation of the printing system 1. The displaced spacer element is arranged above this in an intervening space between recording medium and print head, and thus also acts as a protective element since it prevents a possibly smacking of possible folds, dog-ears, or the like against the print head 2. After passage of the joint 20, the pivot arm 12 is pivoted back into the initial position according to FIG. 5A, and the regular printing process is continued.

FIG. 6 shows a side view of a printing system 1.

The printing system 1 here is configured as an inkjet printing system and has a printing station 19 having a plurality of print bars 15A through 15F. Each of the print bars 15A through 15F contains at least one inkjet print head 2, in particular a plurality of inkjet print heads 2, which are configured to jointly print to an entire width of a recording medium 3 with a predetermined ink or a coating substance. For example, a CMYK (cyan, magenta, yellow, and key or, respectively, black) color system may be involved, wherein a respective print bar, and accordingly at least one print head contained there, is provided to print a defined color of the color system. Moreover, a print bar having at least one print head contained therein is also provided to apply a coating substance or primer, in particular an adhesion promoter and/or a coagulation substance to improve the print quality. In the depicted embodiment, in total six print bars are provided as an example, wherein a reserve print bar 15E for possible special colors, security ink, or the like is provided in addition to the CMYK color bars 15A through 15D and what is known as a primer print bar 15F.

To pass a possible joint 20 detected by means of the sensor 5 upstream of the printing station 19, the spacer elements 6A through 6F are now respectively, individually, locally displaced in succession in the region of the individual print bars 15A through 15F to pass the joint, and displaced back after the passage. A predetermined feed velocity 17 of the recording medium 3 thereby preferably remains set, and after a hold duration—predetermined under consideration of the feed velocity 17—a return displacement of the respective spacer elements 6A through 6F is performed so that the predetermined nip 4 is subsequently reset, and the regular printing process is continued as soon as the joint 20 has passed the respective print bars 15A through 15F or, respectively, their print heads 2.

If a print job for printing to the recording medium 3 provides a predetermined page format, the hold duration may be predetermined using the feed velocity 17 and the page format, so that the nip 4 is reset after a feed length of precisely one or a whole-number multiple of one page, and the printing is continued. Depending on the type of print job, the printing process may continue to run during the spacing, wherein during the spacing a spoilage identifier may be added to the print image, or the printing process may also be interrupted during the spacing and be continued again after the feed length of precisely one or a whole-number multiple of one page.

Here, an automatic roll change system (not shown for better clarity) is preferably upstream of the printing system 1, such that the printing system may continue to run without interruption given a roll change of the recording medium and may directly continue to print after passage of the joint. Such automatic roll change systems are known to the person skilled in the art and do not need more detailed description.

Via the printing system 1, given a roll change the regular printing may be continued directly after passage of the joint and return displacement of the spacer element at each print bar. In particular, no press proof phase whatsoever is necessary for this.

Since the print bars 15A through 15F, and most importantly the entire ink hydraulic system of the printing station 19, do not need to be moved, and thus no consideration needs to be given to the ink hydraulic system (including the ink in the print heads) or the pressure fluctuations due to acceleration, a protective function may be realized with extremely little spoilage with the very rapidly movable spacer element 6A through 6F between the recording medium 3 and a respective print bar 15A through 15F. The respective spacer element 6A through 6F may thereby be designed either as a deflection roll, in particular with comparably small diameter, or as a plate formed as a slider or, respectively, deflection slide plate.

To avoid position errors of the print image, upon introduction of the first spacer element 6A an additional compensation element 14 may be pivoted out from the web of the recording medium 3 at the entrance to the printing station 19. The respective upstream spacer element subsequently always takes over the position compensation. After return displacement of the last spacer element 6F, at the exit of the printing station 19 a further compensation element 14 is also pivoted into the web of the recording medium 3 for position compensation. In the event of a double-sided print job, the downstream compensation element 14 advantageously enables the continued in-register printing of the second side or back side at a downstream second printing station or a downstream second printing system.

For example, the following workflow is possible:

Detection of a joint 20 or adhesive joint by the sensor 5, which in particular is designed as what is known as a "splice sensor" and typically detects, by means of ultrasound, a change of the damping response that is present upon doubling of the recording medium, in particular due to an air gap of the joint 20.

Calculation of the exact desired timing on the basis of feed velocity 17 and the previously known web length between sensor 5 and the first print bar 15A or the respective print bars 15A through F, as well as the page format 21 and a position, following therefrom, of the pages and the position of the joint 20 on the web of the recording medium 3.

Matching of the timing for exact insertion of a spoilage page by the controller or, in the event that this would not be possible with correct timing due to the data buffering, of a point-accurate printing interruption.

As soon as the joint 20 arrives just before the first print bar 15A, this interrupts the actual printing process. A spoilage page or a printing interruption is provided precisely such that it omits the joint from the actual printing. The length of the spoilage page or printing interruption may thereby preferably correspond precisely to one page or a whole-number multiple thereof in order to facilitate subsequent processing steps in the further processing. The insertion of a spoilage page may accordingly be performed via an identifier as spoilage, for example at the start of the page or on a preceding page, via a double-wide cutting mark or the like.

The spacer element 6A is injected into the web or "shot in" with high acceleration between print head 2 and unprinted web of the recording medium 2. To avoid web length changes for the subsequent print bars 15B-F, the compensation element 14 running in the web, arranged before the first print bar 15A, is simultaneously and similarly pivoted out from the web. The required additional web length is thus advantageously not pulled backward from the subsequent print bars 15B-F, but rather is taken in a defined manner from the web region before the printing station 19.

Upon reaching the second print bar 15B, this process is analogously repeated. However, the spacer element of the first print bar 15A is thereby now used for the position compensation or for web length compensation. The compensation element 14 before the first print bar 15A thereby remains pivoted away.

This process is repeated for all subsequent print bars.

After the adhesion joint 20 has passed all print bars 15A through 15F, the last spacer element 6F is displaced back into its initial position. The web length difference that is thereby generated is compensated with an additional compensation element 14 downstream of the last print bar 15F, which compensation element 14 is injected into the web for this.

To return the compensation elements 14, these are subsequently slowly driven back into its original position. The web velocity within the printing station, which changes slightly due to the return of the leading compensation element 14, is detected with high resolution by an encoder 18, and the printing process is adapted accordingly with regard to the velocity.

Insofar as a double-sided printing is provided, the entire workflow may be repeated analogously for the printing to the back side of the recording medium 3 at a downstream second printing system.

Should it be necessary to reduce tolerance lengths, meaning to increase the position precision of the unprinted region, to ensure the desired timing or the exact spoilage pages or printing interruption, the controller 9 may also be designed to trigger a reduction of the feed velocity 17 upon detection of a joint 20 by the sensor, for example a reduction via corresponding slower activation of drive rollers of the printing system 1.

FIG. 7 shows a detailed view of a printing station 19 according to one embodiment.

As described with regard to FIG. 6, it is likewise a printing station 19 having (purely as an example) six print bars 15A through 15F. At least one print head 2 is contained in each print bar 15A through 15F. A spacer element 6A through 6F is also associated with each print bar.

In the shown embodiment, the spacer elements 6A through 6F are designed as deflection rollers 10 which are respectively attached to a pivot lever 12. The pivot lever can respectively be pivoted around a predetermined rotation point 13A through 13F. In the shown embodiment, the rotation points 13A through 13F are, as an example, arranged above the recording medium 3 and attached to the respective print bar 15A through 15F.

In an initial position, the spacer elements 6A through 6F here are arranged at an angle to the recording medium 3, as is apparent at the spacer elements 6A, 6B, 6D, 6E, and 6F. At the associated print bars 15A, 15B, 15D, 15E, and 15F, the respective predetermined nip 4 relative to the recording medium is set.

In a displaced position, as is shown here by way of example at the third spacer element 6C, the spacer element pivots by way of an actuator around the rotation point 13D in the direction of the recording medium 3 so that it engages in the recording medium 3 and locally deflects this in a direction opposite the print head 2 in the region of the print bar 15D, and thus establishes an increased distance 8. It also engages in an intervening space between recording medium 3 and print bar 15C, and therefore simultaneously forms a protective element for the print bar.

The in- and out-coupling of the spacer elements 6A through 6F is produced in the manner of a cascade, beginning at the first spacer element 6A. The locally required web length is respectively modified via the in-coupling of the first spacer element 6A and the out-coupling of the last spacer element 6F. To compensate for this web length change, a respective compensation element 14 that can be actuated by means of an actuator is provided upstream of the first spacer element 6A and downstream of the last spacer element 6F, which compensation element 14 is configured for position compensation of the recording medium 3 via a counter-movement upon displacement of the spacer element 6A or, respectively, 6F. In the shown embodiment, a compensation element 14 is upstream of the first spacer element 6A and a compensation element 14 is downstream of the last spacer element 6F. For example, the compensation element 14 can be configured so as to be pivotable by means of an actuator around a rotation point, analogous to the spacer elements, at a deflection roller mounted on a pivot lever.

A controller 9 (not shown here for the sake of better clarity) of the printing station 19 is configured to displace and return the spacer elements 6A, 6B, 6C, 6D, 6E, 6F so as to match one another so that a respective return displacement can be executed as a counter-movement to a displacement of the subsequent spacer element for position compensation of the recording medium 3. For position compensation at the start and at the end of the printing station, the controller 9 controls the controller 9 as well as the respective compensation element 14 upon displacement of the associated spacer element 6A or, respectively, 6F for position compensation. In this way, in spite of the length change of the web of the recording medium 3 that is produced with the spacer elements 6A, 6F, the registration or the register of the print is maintained at the other print bar not currently affected by the displacement. Printing may thus continue there, and a spoilage generated by the cascade-like progressive displacement may in this way be provided so as to be shorter than the length of the printing station 19.

If a joint has been channeled through the printing station 19, after passage of the joint the compensation element is reset again into an initial position multiple times more slowly than in the counter-movement. A feed velocity of the recording medium that was thereby temporarily modified is detected by the encoder 18 arranged downstream of the last print bar 15F, and the printing process is adapted to the modified velocity, as this is provided in a printing system anyway for compensation of possible web feed fluctuations.

FIG. 8 shows a detail view of a printing station 1 according to a further embodiment.

In contrast to FIG. 7, here the rotation points 13A through 13F are situated on the side of the recording medium 3 opposite the print bars 15A through 15F. For example, here the rotation points 13A through 13F may be provided on a frame of the printing station 19 bearing the deflection rollers 16.

FIG. 9 shows a detail view of a printing station 1 according to yet another embodiment.

In this embodiment, which is based on the embodiment according to FIG. 7, the spacer elements 6A through 6F are designed not as deflection rollers 10 but rather as deflection slide plates 11 attached to the pivot lever 12. These are respectively designed as a curved or bowed plate extending over the entire width of the recording medium 3, along which the recording medium 3 slides upon coupling, as is shown by way of example using the third spacer element 13C.

Since the deflection slide plate 11 is designed curved with a greater curvature radius than a deflection roller, the distance 8 may in this way be more uniform, or be adjusted uniformly over a greater length. The deflection slide plate 11 may also be designed to be flatter than a deflection roller, such that its height requires less installation space.

FIG. 10 shows a diagram of the acceleration (a) for spacing over the spoilage length s necessary for the spacing.

In this diagram, a typical maximum permissible acceleration (a) of a print head or of its ink system is plotted with a horizontal line. The hyperbolic curve that is furthermore plotted represents a movement equation of the accelerations a necessary given various spoilage lengths s. For shorter spoilage lengths s, higher accelerations (a) are necessary in order to be able to implement the spacing within the predetermined spoilage length s.

Qualitatively, a spacer element must be displaced from the initial position into the displaced position and back into the initial position within a time period dependent on the feed velocity 17. For this, acceleration processes are respectively necessary that need to run as sufficiently quickly so that, in the displaced state, the joint may be directed past the print head. For these acceleration processes, a clear length is available which depends on the predetermined spoilage length, for example one spoilage page, minus the length of the joint and minus the print head length, often minus the length of the entire print bar. Conversely, this means that a minimum spoilage $s_{min}$ may not be shorter than the sum of the length of the joint and the length of the print head. Inasmuch as the spoilage length is approached, the acceleration necessary for this tends toward infinity.

According to the disclosure, much, much higher acceleration values are now possible with a spacer element than were possible previously via the displacement of a print bar, since this is limited to a maximum permissible acceleration due to the ink hydraulic system. This is drawn here using the horizontal line, as an example A—purely mathematical—absolute minimum spoilage length with such conventional systems exists at an intersection point G between the horizontal line and hyperbolic line.

A right portion of the diagram with greater spoilage length s, starting from the intersection point G, would thus theoretically still be realizable with a conventional displacement of a print head, whereas a portion of the diagram with lesser spoilage length s, lying to the left of the intersection point G, is possibly only with the use of spacer elements according to the disclosure.

Due to the much, much greater accelerations of a spacer element 6 that are possible according to the disclosure in comparison to a print head, it is now possible to go far below this limit G, as is symbolized using the drawn dots of possible accelerations of the spacer element 6, as an example. For example, at least three times smaller spoilage lengths are possible. The spoilage can thus, as an example, be limited to a single spoilage page, for example in DIN A4 or 12-inch format, for which high accelerations of the spacer elements 6 are used. The accelerations are in particular multiple times the range permitted for the displacement of a print head 2.

Although the present disclosure has been described using preferred exemplary embodiments, it is not limited to these, but rather can be modified in numerous ways.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 printing system
2 print head
3 recording medium
4 nip
5 sensor
6 spacer element (spacer)
6A-F spacer elements (spacers)
7 actuator
8 distance
9 controller
10 deflection roller
11 deflection slide plate
12 pivot lever
13 rotation point
13A-F rotation points
14 compensation element (compensator)
15A-F print bar
16 deflection roller
17 feed velocity
18 encoder
19 printing station
20 joint
21 page format
a acceleration
G intersection point
spoilage length
$s_{min}$ minimum spoilage

The invention claimed is:

1. A printing system, comprising:

at least one print head that is arranged with a predetermined nip and configured to print to a recording medium;

a sensor positioned upstream of the at least one print head, and configured to detect joints of the recording medium;

a spacer arranged in a region of the at least one print head on a same side of the recording medium as the at least one print head, and configured to be displaceable to engage the recording medium in order to deflect the recording medium and to increase a distance between the at least one print head and the recording medium;

an actuator configured to displace the spacer; and a controller configured to activate the actuator to displace the spacer based on a detection of a joint by the sensor, the spacer including a pivot lever that is configured to be pivotable, by the actuator, around a rotation point to increase the distance between that at least one print head and the recording medium, wherein:

the rotation point is arranged on the same side of the recording medium as the at least one print head, or the rotation point is arranged on an opposite side of the recording medium from the at least one print head.

2. The printing system according to claim 1, further comprising a compensator, that is actuatable by the actuator, provided upstream and/or downstream of the spacer, the compensator being configured to position the recording medium to compensate for a position of the recording medium via a counter-movement upon displacement of the deflection element, wherein the controller is configured to control the compensator.

3. The printing system according to claim 1, further comprising a plurality of print bars, spaced apart from one another in a feed direction, and respectively including at least one print head, wherein:

a spacer is respectively associated with each of the plurality of print bars, the respective spacers each being configured to space the recording medium from the respective one of the plurality of print bars; and the controller is configured to displace and return the spacers so as to match one another, so that a respective return displacement is provided as a counter-movement to a displacement of a subsequent spacer to compensate for a position of the recording medium.

4. The printing system according to claim 1, wherein, upon displacement of the spacer, the distance between the at least one print head and the recording medium is produced and is multiple times greater in comparison to the nip.

5. The printing system according to claim 4, wherein the distance between the at least one print head and the recording medium that is produced is at least ten times greater than the nip.

6. The printing system according to claim 4, wherein the distance between the at least one print head and the recording medium that is produced is at least twenty times greater than the nip.

7. The printing system according to claim 1, wherein the spacer is configured to engage the recording medium in an intervening space between the recording medium and the at least one print head.

8. The printing system according to claim 1, wherein the rotation point is arranged on the same side of the recording medium as the at least one print head.

9. The printing system according to claim 1, wherein the rotation point is arranged on the opposite side of the recording medium from the at least one print head.

10. A method for protecting a print head upon printing to a recording medium, comprising:

printing to the recording medium using at least one print head, wherein a predetermined nip is set;

checking the recording medium, using a sensor upstream of the at least one print head, to detect possible joints of the recording medium; and in response to a detection of a joint, displacing, using an actuator, a spacer to locally deflect the recording medium in a region of the at least one print head to increase a distance between the at least one print head and the recording medium, wherein:

a predetermined feed velocity of the recording medium is maintained upon displacement of the spacer; and after a hold duration under consideration of the feed velocity, a return displacement of the spacer is performed so that the predetermined nip is reset, and a regular printing process is continued as soon as the detected joint has passed the at least one print head.

11. The method according to claim 10, wherein:

a print job for printing to the recording medium provides a predetermined page format and the displacement by the actuator; and a calculation is performed to determine a point in time of the displacement and the hold duration, the calculation being based on the feed velocity, the page format, and a position of the detected joint relative to one or more pages, such that the nip is reset after a feed length of one page or a whole-number of multiples of a page.

12. A non-transitory computer-readable storage medium with an executable program stored thereon, wherein, when executed, the program instructs a processor to perform the method of claim 10.

13. A printing system, comprising:

a first print bar and a second print bar spaced apart from the first print bar in a feed direction, the first print bar including a first print head arranged with a predetermined first nip and configured to print to a recording medium, and the second print bar including a second print head arranged with a predetermined second nip and configured to print to the recording medium;

a sensor positioned upstream of the first print head and the second print head, and configured to detect joints of the recording medium;

a first spacer associated with the first print bar and arranged in a region of the first print head, the first spacer being configured to be displaceable to deflect the recording medium and to increase a distance between the first print head and the recording medium;

a second spacer associated with the second print bar and arranged in a region of the second print head, the second spacer being configured to be displaceable to deflect the recording medium and to increase a distance between the second print head and the recording medium;

a first actuator configured to displace the first spacer;

a second actuator configured to displace the second spacer; and a controller configured to:

activate the first and second actuators to respectively displace the first and second spacers based on a detection of a joint by the sensor; and displace and return the first and second spacers so as to match one another, so that a respective return displacement is provided as a counter-movement to a displacement of a subsequent one of the first and second spacers to compensate for a position of the recording medium.

* * * * *